United States Patent [19]

Vogele et al.

[11] 4,104,024

[45] Aug. 1, 1978

[54] PROCESS FOR STERILIZATION, MORE PARTICULARLY FOR STERILIZATION OF PACKAGING MATERIALS

[75] Inventors: Peter Vogele, Sindelfingen; Diethard Schulte, Hochheim, both of Fed. Rep. of Germany

[73] Assignee: Tetra Pak Developpement, S.A., Lausanne, Switzerland

[21] Appl. No.: 798,822

[22] Filed: May 20, 1977

[30] Foreign Application Priority Data

May 29, 1976 [DE] Fed. Rep. of Germany ..... 2624264

[51] Int. Cl.[2] ..... A61L 13/00; B65B 55/10; B08B 3/08

[52] U.S. Cl. ..... 21/58; 21/91; 23/253 A; 53/167; 134/15; 134/27

[58] Field of Search ..... 21/58, 91, 92; 23/253 A; 53/167; 134/15, 27

[56] References Cited

U.S. PATENT DOCUMENTS

| | | | |
|---|---|---|---|
| 2,063,140 | 12/1936 | Allison | 23/253 A UX |
| 3,383,831 | 5/1968 | Goldsmith et al. | 21/58 X |
| 3,440,003 | 4/1969 | Tuma | 21/58 |
| 3,560,166 | 2/1971 | Walles | 134/27 X |
| 3,698,867 | 10/1972 | Bielefeld, Jr. et al. | 23/253 A X |
| 3,898,095 | 8/1975 | Berdan et al. | 134/27 X |
| 3,929,409 | 12/1975 | Buchner et al. | 21/58 X |
| 3,989,465 | 11/1976 | Onnen | 23/253 A X |

*Primary Examiner*—Morris O. Wolk
*Assistant Examiner*—Roger F. Phillips
*Attorney, Agent, or Firm*—Hauke and Patalidis

[57] ABSTRACT

A process for sterilizing an article, more particularly packaging material, by wetting the article with a sterilizing solution having an active-chlorine-concentration in the range of 500 to 20,000 mg/l, and treating the sterilized article with an aqueous solution of hydrogen peroxide to deactivate any remaining active-chlorine.

16 Claims, 2 Drawing Figures

PROCESS FOR STERILIZATION, MORE PARTICULARLY FOR STERILIZATION OF PACKAGING MATERIALS

BACKGROUND OF THE INVENTION

The present invention relates to a process for sterilization, especially for the sterilization of packaging materials (and in particular plastic materials and materials having a plastic coating), by wetting with an active-chlorine-containing sterilizing solution.

Processes of this type are used, for example, in the sterilization of packaging for milk or other drinks or foodstuffs, where the packaging material is a web of plastic material or plastic-coated foil. In known processes, the packaging material is sterilized by an approximately 30% solution of hydrogen peroxide at a high temperature (about 90° C.). Such a process should destroy all bacteria spores which could spoil the food or lead to food poisoning. However, the heating required for such a process is complex and expensive, and the subsequent elimination of the hydrogen peroxide, which is used in high concentration, may be dangerous for the operators. Also because of the high hydrogen peroxide concentration, there is the risk of dangerous residues remaining in the packaged foodstuff.

We have now discovered a reliable process for sterilizing the surfaces of packaging materials, which process will destroy bacterial spores at a relatively low temperature while allowing the sterilization solution to be handled without danger and without any undesirable residues remaining in the packaged product.

SUMMARY OF THE INVENTION

Thus, the present invention consists in a process for sterilizing an article by wetting said article with a sterilizing solution having an active-chlorine concentration of from 500 to 20,000 mg/1 and treating the thus sterilized article with an aqueous solution of hydrogen peroxide to deactivate any remaining active chlorine.

For the sterilization itself active-chlorine-containing solutions of relatively high concentration are used, whereas in known methods they are not used because of the residues that result. In the process of the present invention the harmful active-chlorine residues are made harmless by the addition of hydrogen peroxide, the concentration of which may be kept so low that the usual disadvantages of hydrogen peroxide treatment do not occur.

BRIEF DESCRIPTION OF THE DRAWING

Two preferred embodiments of the process of the present invention are illustrated in the accompanying drawing.

DETAILED DESCRIPTION OF THE PREFERRED EMBODIMENTS

Figure 1:
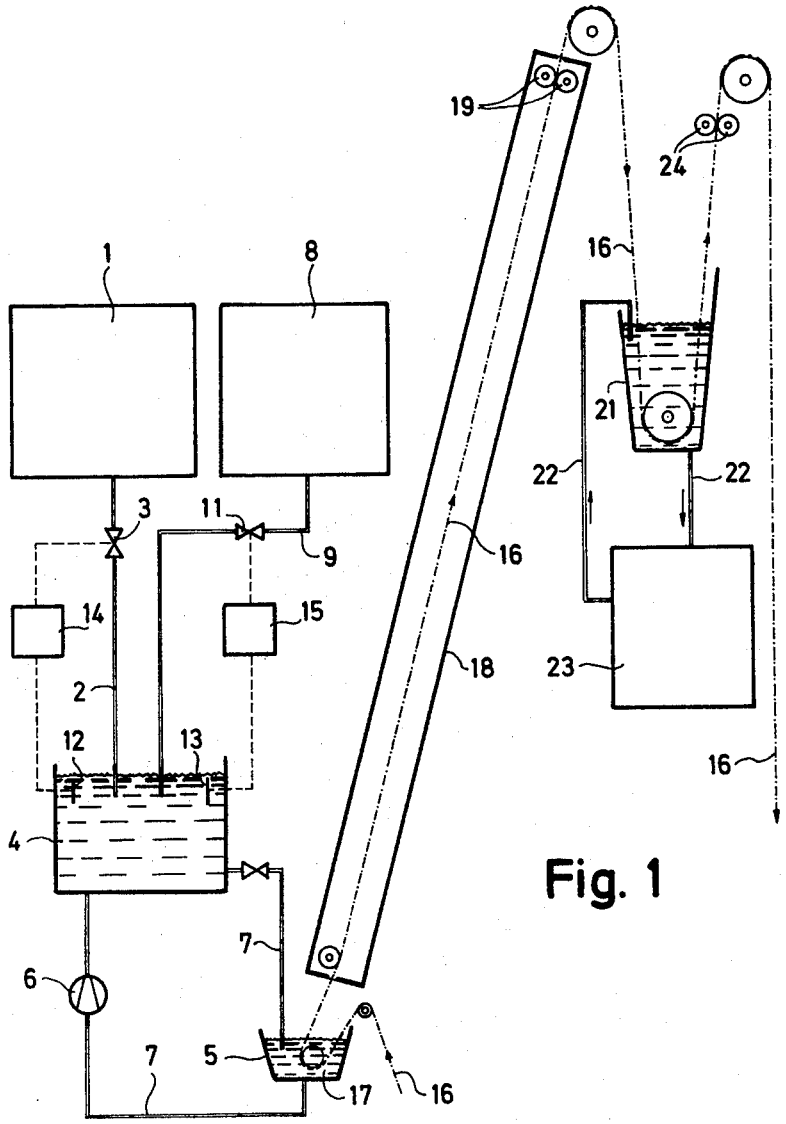
FIG. 1 is a diagrammatic representation of a preferred apparatus for carrying out the process according to the invention.
Figure 2:
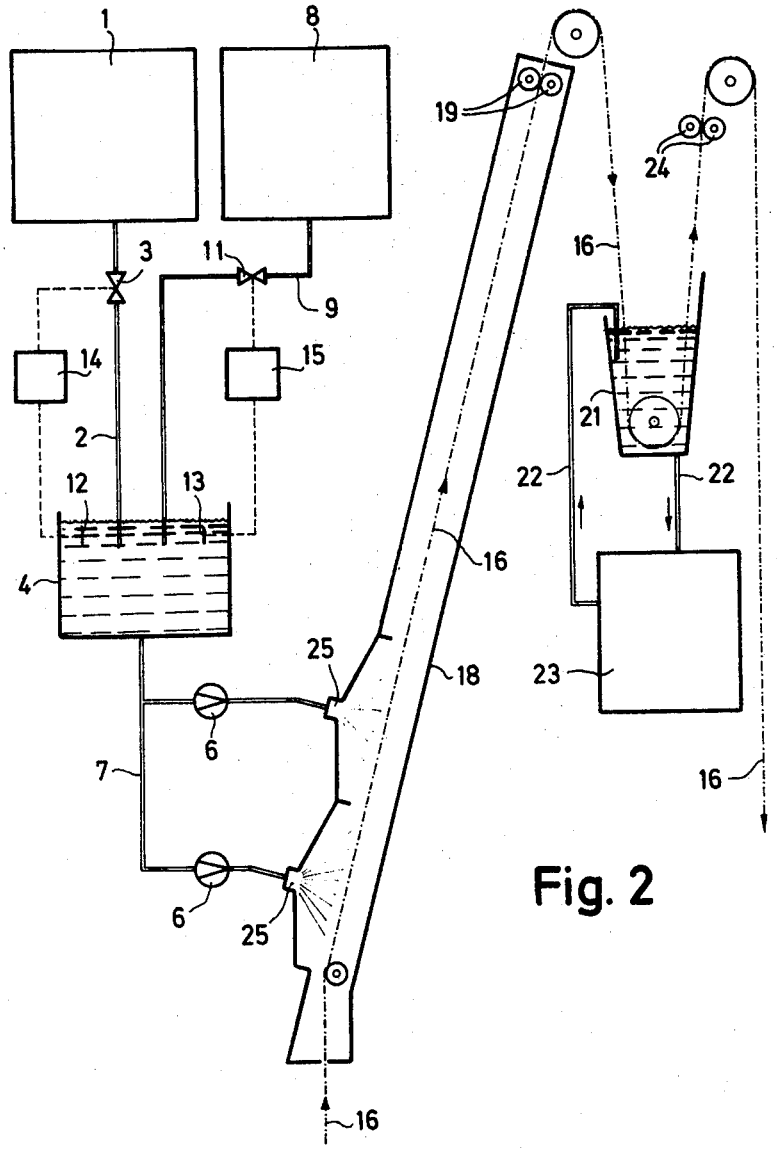
FIG. 2 is a diagrammatic illustration of a modification of the apparatus shown in FIG. 1.

The apparatus of FIG. 1 and FIG. 2 can conveniently be used for sterilizing strips of polyethylene coated packaging material such as is used in the production of milk cartons. In FIG. 1, a tank 1 contains a chlorine bleach solution (pH 12 and active chlorine concentration about 100 g/l) and is connected by a pipe 2 having a valve 3 to a storage vessel 4 (capacity about 3 1). The solution is continuously recycled by a pump 6 through a pipe 7 between the vessel 4 and an immersion bath 5.

The temperature of the sterilizing solution in the immersion bath 5 is preferably maintained at about 60° C. A tank 8 is connected by a pipe 9 and a valve 11 to the storage vessel 4. The tank 8 is a container for an acid (conveniently 70% phosphoric acid) or an alkali which is used to adjust the pH of the solution in the vessel 4 and bath 5. Sensors 12 and 13 (which measure redox potential and pH respectively) in conjunction with a redox control circuit 14 and a pH control circuit 15 are used to operate the valves 3 and 11 to control the active chlorine concentration and the pH of the solution in the storage vessel 4 (the preferred values are 10,000 mg/l and 8 respectively). The absolute active-chlorine concentration may also be determined simply by titration with sodium thiosulphate, giving a value in ppm of chlorine instead of in mg/l. Active chlorine as referred to herein means this titratable chlorine.

A web of packaging material 16 to be sterilized is led over a roller 17 in the bath 5. The wetted web is then passed through a chamber 18 (about 2 meters in length), at such a speed that about 10 seconds are available for sterilization, at the end of which are disposed two squeeze rollers 19 for removing the major part of the sterilizing solution adhering to the packaging material. About 300 ml/hour of sterilizing solution passes beyond the squeeze rollers 19 when the running speed of the packaging material is the optimum value of about 20 cm/second for a chamber 2m. in length.

In order to remove the remaining active-chlorine, the web 16 is fed through a wash bath 21 containing an aqueous solution of hydrogen peroxide (preferably 0.2% by weight). Pipes 22 and a pump (not shown) connect the wash bath 21 to a tank 23 which stores the aqueous hydrogen peroxide (preferably at room temperature e.g. 20° C). The capacity of the tank 23 is such that the hydrogen peroxide concentration in the wash bath 21 during one production day does not fall by more than 10% as a result of the reaction with the active chlorine. Squeeze rollers 24 or a powerful jet of sterile air are used to remove excess liquid from the web 16. A packaging container may then be constructed from the web and filled with, for example, milk. It has been found that in the worst case a maximum of about 0.1 ml of 0.2% aqueous hydrogen peroxide can remain in a 1 liter container. This concentration (0.2 mg/l) is approximately the same as that achieved by other substantially more complicated processes.

The apparatus shown in FIG. 2 differs from that shown in FIG. 1 in that the web 16 is sterilized by spraying a fine film using two turbo atomizers 25 instead of by passing it through an immersion bath. The diameter of the droplets produced by the atomizers may be about 10$\mu$.

An advantage of the process of the present invention is that a sufficiently reliable sterilization can be obtained, without the use of a high temperature and the necessary costly equipment. The residues remaining on the packaging material after treatment do not contravene foodstuffs regulations.

The reduction in the bacteria spore count after sterilization may be determined in the following manner: a sterilizing solution is poured over dry bacteria spores (with garden earth as the carrier) and/or dry mould spores (with sea sand as the carrier); after 15 seconds a part of the resulting suspension is added to a sodium thiosulphate solution to deactivate the sterilizing solution. The surviving spore or germ count is then determined by Koch's plate method. This count is then compared with that after heating for 10 minutes at 80° C. This latter treatment, known as "water control", destroys vegetative germs. Applying the following formula to the two germ counts gives the "decimal destruction rate" (R) which is a measure of the effectiveness of the sterilization process. Values of R between 3 and 4 (a reduction in the spore count by a factor of from 1,000 to 10,000) are accepted as sufficient in foodstuffs chemistry.

$$R = \log \frac{\text{control germ count}}{\text{germ count after sterilization}}$$

The effectiveness of the process of the present invention can be seen from Tables 1 and 2 below. Table 1 relates to conventional sterilization using an approximately 30% aqueous solution of hydrogen peroxide. It can be seen from this Table that only at very high temperatures is a satisfactory R value obtained. Table 2 shows the R value for sterilization according to the present invention, the last line of Table 2 indicates that if the active chlorine concentration is too low the sterilization is insufficient. Earth spores and Aspergillus niger bacteria were used for this comparison.

Table 1

| Sterilization medium | Temperature | R values of Earth spores | Aspergillus niger |
|---|---|---|---|
| 30% $H_2O_2$ by wt. | 20° C | 1.76 | 4.05 |
| 30% $H_2O_2$ by wt. | 60° C | 2.13 | 6.30 |
| 30% $H_2O_2$ by wt. | 90° C | 3.61 | over 7.5 |

Table 2

| Sterilization medium | Temperature | R values of Earth spores | Aspergillus niger |
|---|---|---|---|
| 2.0 g/l Cl (pH 8) | 20° C | 3.43 | 4.82 |
| 9 g/l Cl (pH 8) | 20° C | 3.18 | 4.17 |
| 1.1 g/l Cl (pH 8) | 60° C | 3.46 | 5.10 |
| 0.11 g/l Cl (pH 8) | 60° C | 1.65 | 3.75 |

The following substances are suitable for preparing sterilizing solutions, preferably aqueous sterilizing solutions, according to the present invention:
sodium hypochlorite;
calcium hypochlorite;
chlorinated trisodium phosphate;
chlorine dioxide;
sodium p-toluenesulphochloroamide;
p-toluenesulphonsulphochloroamide;
N-chlorosuccinimide;
1,3-dichloro-5, 5-dimethylhydantoin;
trichloroisocyanuric acid and salts thereof;
dichloroisocyanuric acid and salts thereof;
trichloromelamine or dichloroglycoluril.

We claim:

1. A process for sterilizing an article by wetting said article at a temperature below 70° C with a sterilizing solution of a compound having an active-chlorine concentration of from 500 to 20,000 mg/l and being selected from the group consisting of sodium hypochlorite, calcium hypochlorite, chlorinated trisodium phosphate, chlorine dioxide, sodium p-toluenesulfochloroamide, p-toluene-sulfonsulfochloroamide, N-chlorosuccinimide, 1, 3-dichloro-5, 5-dimethylhydantoin, trichlororoisocyanuric acid, salts of trichloroisocyanuric acid, trichloromelamine and dichloroglycoluril, the pH of said sterilizing solution being from 8 to 10, and treating the thus sterilized article with an aqueous solution of hydrogen peroxide at a temperature below 90° C to deactivate any remaining active chlorine, said solution of hydrogen peroxide having a concentration of lower than 30%.

2. A process according to claim 1, in which said sterilizing solution has an active-chlorine concentration from 800 to 12,000 mg/l.

3. A process according to claim 1, in which said temperature is from 20° to 60° C.

4. A process according to claim 1, in which said sterilizing solution acts on said article for from 10 to 60 seconds.

5. A process according to claim 1, in which said article passes through a bath containing said sterilizing solution.

6. A process according to claim 1, in which said article is sprayed with said sterilizing solution.

7. A process according to claim 5 in which the pH of said sterilizing solution is continuously controlled by monitoring the pH and adding the requisite amount of an acid or alkali.

8. A process according to claim 6, in which the pH of said sterilizing solution is continuously controlled by monitoring the pH and adding the requisite amount of an acid or alkali.

9. A process according to claim 5, in which the concentration of said sterilizing solution is continuously controlled by monitoring its redox potential and adding the requisite amount of active-chlorine-containing compound.

10. The process according to claim 6, in which the concentration of said sterilizing solution is continuously controlled by monitoring its redox potential and adding the requisite amount of active-chlorine-containing compound.

11. The process according to claim 7, in which the concentration of said sterilizing solution is continuously controlled by monitoring its redox potential and adding the requisite amount of active-chlorine-containing compound.

12. A process according to claim 1, in which said article is immersed in said aqueous solution of hydrogen peroxide.

13. A process according to claim 1, in which said article is sprayed with said aqueous solution of hydrogen peroxide.

14. A process according to claim 1, in which excess sterilizing solution is removed from said article by rolling.

15. A process according to claim 1, in which excess aqueous hydrogen peroxide is removed from said article by rolling.

16. A process according to claim 1, in which excess sterilizing solution and excess aqueous hydrogen peroxide are removed from said article by rolling.

* * * * *